United States Patent [19]

Takeuchi

[11] Patent Number: 5,058,891

[45] Date of Patent: Oct. 22, 1991

[54] FITTING-ANGLE ADJUSTMENT MARK FOR GRIP OF GOLF CLUB

[76] Inventor: Mikio Takeuchi, c/o Yuugenkaisha Takeuchi Mikio Design Office, No. 3-17, Minamiaoyma 3-chome, Tokyo-to, Japan

[21] Appl. No.: 514,262

[22] Filed: Apr. 25, 1990

[51] Int. Cl.[5] ..... A63B 53/00

[52] U.S. Cl. ..... 273/81 B; 273/81.2; 273/81.3; 273/163 A; 273/183 R

[58] Field of Search ..... 273/81 R, 81 B, 81 D, 273/81.2, 81.3, 81.4, 81.5, 81.6, 163 R, 163 A, 164, 32 R, 32 A, 32 H, 35 R, 183 R, 183 D, 183 DA, 183 E, 186 R, 186 A, 186 C, 186 RA, 193 R, 194 R

[56] References Cited

U.S. PATENT DOCUMENTS

| | | | |
|---|---|---|---|
| 1,488,900 | 4/1924 | Armstrong | 273/163 R |
| 1,603,850 | 10/1926 | Keating | 273/163 A |
| 2,149,911 | 3/1939 | East | 273/81.4 |
| 3,684,294 | 8/1972 | Champion | 273/183 D |
| 4,195,837 | 4/1980 | Poulin | 273/81 R |
| 4,204,332 | 5/1980 | Gray | 273/183 D X |
| 4,482,155 | 11/1984 | Higley | 273/164 X |
| 4,569,525 | 2/1986 | Folger | 273/186 A |

*Primary Examiner*—William H. Grieb

*Attorney, Agent, or Firm*—Birch, Stewart, Kolasch & Birch

[57] ABSTRACT

A fitting-angle adjustment mark for a grip of a golf clug is disclosed. The rear end surface of the grip, which fits on the rear portion of a club shaft, provides indicies or graduations of the mark directly or by means of an element separate from the grip at predetermined angular intervals with reference to a back line of the grip. The mark enables a golfer to fit the grip on the rear portion of the club shaft so that a fitting angle of the grip relative to a club face is accurately easily adjusted to a correct angle in accordance with his particular putting.

6 Claims, 3 Drawing Sheets

FITTING-ANGLE ADJUSTMENT MARK FOR GRIP OF GOLF CLUB

BACKGROUND OF THE INVENTION

1. Field of the Invention

The present invention relates to a fitting-angle adjustment mark for a grip of a golf club.

2. Description of the Related Art

As is well known, a golf club grip provides the contact between a golfer and a golf club. Thus, a proper gripping of the grip enables the golfer to make a proper golf swing and a low score.

The grip is generally made of an elastic material, e.g., rubber, fits the golfer's hands and is in the form of a bottomed hollow cylinder. An axial center of a back portion of the outer cylindrical surface of the grip has a ridge called a back line.

In accordance with a golf club for an average golfer, in particular, a wood club, the back line of the grip fitted on the club shaft extends in parallel to the club face so that the club face provides a straight arrangement of the golf club.

On the other hand, the club face of a club for a particular golfer or a professional golfer is designed to provide a hook or slice arrangement of the golf club in accordance with his usual hitting of the ball. That is, the grip fits on the club shaft so that the back line of the grip has desired angles of 10 or 20 degrees oblique to the club face.

Thus, the fitting angle of the back line of the grip to the club face must exactly match the angles desired by a golfer. Since most of the grip is made of rubber, as described above and like to wear, a wire is included in the grip in order to increase the endurance of the grip. However, the grip used by one particular golfer or professional golfer quickly wears far beyond his own estimate. The professional golfer will have weekly tournaments during a season and often exchanges the grip in accordance with his play condition.

The grip is fixed with a pressure sensitive adhesive double coated tape wound around the shaft rear portion to the shaft rear end. In an exchange of the grip for another grip, a cutter or the like separates a worn grip from the club shaft rear end and then the old tape is removed. Any tape residue is also removed with benzine so as to clean the shaft rear portion.

A fresh pressure sensitive adhesive double coated tape is wound around the shaft rear portions and then sprayed with benzine. In addition, benzine is also sprayed onto the inner surface of a fresh tubular grip which is slid onto the shaft rear portion through an insertion opening of the grip and fits on the shaft rear portion.

Thus, it is important to fit a grip on the shaft rear end so that the back line of the grip extends at angles relative to the club face desired by a golfer.

However, as shown in FIG. 4, a prior-art grip has only a rear edge surface 20 with a manufacturer mark 21 or outer cylindrical surface with a scrollwork (not shown). No prior-art grip has a mark which indicates how many angles relative to the club face the grip is fitted on the shaft rear portion.

Thus, the grip is often actually fitted on the shaft rear end on the basis of perception and visual estimate.

However, such fitting of the grip will sometimes fail even with the greatest possible care in setting the fitting angle of the back line of the grip to equal the desired value, so that the fitting of the grip on the shaft rear end is liable to be inexact. In particular, gripping such inexactly fitting grip subtly changes the feeling of his grip for a top professional golfer, which adversely will affect his shot. Additionally, when the frequency of exchanging the grip is high, exchanging the grip is very troublesome.

Additionally, spraying benzine to the inner surface of the grip in the exchange of the grip causes softening of the grip, so that handling thereof is troublesome and the grip is difficult to properly fit on the shaft rear end. Thus, the grip will sometimes fit on the shaft rear end with the axis of the grip distorted.

In addition, since usually a custom-made golf club is utilized, the grip is fitted on the shaft rear portion in accordance with a swing of a golfer so that the fitting angle of the back line of the grip relative to the club face is adjusted to be the desired value. However, the fitting angle of the back line of the grip is adjusted on the basis of perception and or visual estimate to be 10 or 20 degrees.

In any of the above cases, the adjustments in the fitting angle of the grip is carried out on the basis of perception and visual estimate, so that it is difficult to fit the grip on the shaft rear portion in an exact and very easy adjustment.

SUMMARY OF THE INVENTION

Therefore, the present invention was made with a view of an elimination toward the above drawbacks. An object of the present invention is to provide a fitting-angle adjustment mark for a grip of a golf club provided on the rear end surface of a grip and constituting an index by which the grip can be fitted on a club shaft rear portion in an exact, very easy adjustment so that the back line of the grip defines desired angles relative to the club face in accordance with a particular swing of a golfer in order to provide a golf club having a straight, hook or slice arrangement.

In order to achieve this object, the fitting-angle adjustment mark for the grip of the golf club has the following features: The rear end surface of the grip, the grip being in the form of bottomed hollow cylinder and fitting on the rear end of the golf club, provides indices or graduations directly or by means of an element separate from the grip at predetermined angular intervals with reference to the back line of the grip.

Radially extending grooves defined in the rear end surface of the grip may constitute the graduations. Alternatively, radially extending ridges provided on the rear end surface of the grip may constitute the graduations. The grooves and ridges may be colored. The graduations may comprise a reference graduation provided at a predetermed angular distance from the position of the back line of the grip, great graduations at 45 degree intervals progressively from the reference graduation, middle graduations at 22.5 degree intervals progressively from the reference graduation between the reference graduation and great graduations, and small graduations at 11.25 degree intervals progressively from the reference graduations between the reference graduation, great graduations and middle graduations. The graduations may radially extend and the distal end of at least one of the graduations have a circular arc extending circumferentially of the rear edge surface of the grip, the distal end of the arc having an arrow head. A seal stamp or a plate having the graduations and separate from the grip may be attached to the rear end surface of the grip.

The grip is positioned onto the club shaft rear end as follows: First, a pressure sensitive adhesive double coated tape is wound around the club shaft rear portion and benzine is sprayed onto the wound tape. Additionally, benzine is also sprayed onto the inner surface of the grip, then the fitting angle of the grip is adjusted by means of a desired graduation on the edge surface of the grip and then the grip is slid onto the club shaft rear portion. Thus, the fitting angle of the grip between the back line of the grip and the club face can accurately agree with predetermined angles.

The fitting-angle adjustment mark for the grip has the following advantages;

1) Since the rear end surface of a grip of the present invention has the marking graduations provided at predetermined angular intervals, the grip can be easily fitted on the shaft rear portion when the grip is first fitted or exchanged so that the grip fitting-angle accurately equals desired angles.
2) Since in addition, the rear end surface of the grip has the graduations, a golfer directs his eye at the rear end surface of the grip and can very easily, accurately confirm an alignment of at least one of the graduations with the club face.
3) Since the fitting angle of the grip will not be based on the perception or a visual estimate as in the prior-art grip, anyone can fit the grip in a short time, in particular, a professional golfer, who frequently exchanges the grip, can greatly save time in the exchange of the grip.
4) When the golf club is custom-made, it can provide a golf club with a grip having a fitting angle fitting the user of the golf club.
5) Since the fitting-angle adjustment mark for the grip is provided directly on the rear end surface of the grip or a seal stamp or a plate separate from the grip and having the fitting-angle adjustment mark for the grip is attached to the rear edge surface of the grip, the grip can be employed in a formal golf contest without a violation of any pertinent rules.

DESCRIPTION OF THE PREFERRED EMBODIMENTS

Figure 1:
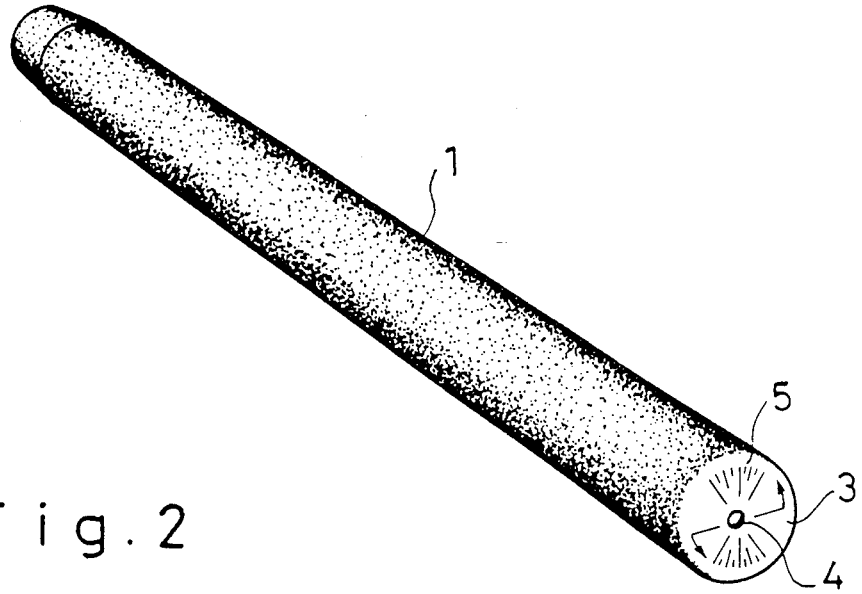
FIG. 1 is a perspective view of a golf club grip of the present invention.
Figure 2:
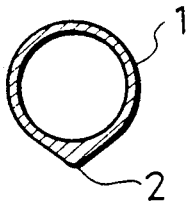
FIG. 2 is a cross-section through a portion of the grip of FIG. 1 near the rear end thereof.
Figure 3:
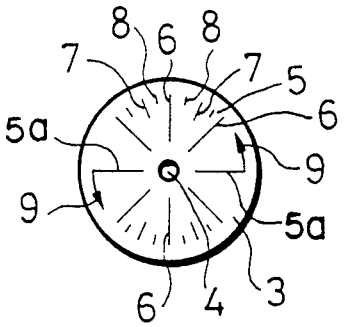
FIG. 3 is a rear view of the grip of FIG. 1.
Figure 4:
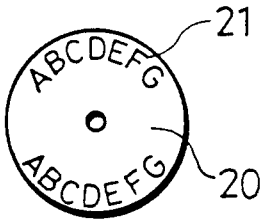
FIG. 4 is a rear view of a prior-art golf club grip.

Hereinafter, the preferred embodiments of the present invention will be described with reference to the drawings. A hollow cylindrical grip made of a suitable material, e.g., rubber, is indicated at 1. The cylindrical surface of the grip 1 has a design comprising a name of a club maker and a scrollwork (not shown). A back line of the grip in the form of a slightly thickened ridge is indicated at 2. The rear end surface of the grip 1 is indicated at 3. The center of the rear end surface 3 has an opening 4 therein. The rear end surface 3 has a plurality of graduations 5 radially extending and provided at predetermined angular intervals around the opening 4.

The graduations 5 may be either grooves defined in or ridges formed on the rear end surface 3. The grooves or ridges of the graduations 5 may be colored with an applied paint. Of course, the graduations 5 may be formed with markings written with a color paint on the rear end surface 3 of the grip 1.

In accordance with the embodiment of FIGS. 1–5, the graduations 5 include a pair of reference graduations 5*a* provided symmetrically of the position of the back line 2, radially extending long graduations 6 provided at 45 degree intervals progressively from the reference graduations 5*a*, radially extending intermediately long graduations 7 provided at 22.5 degree intervals progressively from the reference graduations 5*a* between the reference graduations 5*a* and long graduations 6, and radially extending short graduations 8 provided at 11.25 degree intervals progressively from the reference graduations 5*a* between the reference graduations 5*a*, long graduations 6 and intermediately long graduations 7. However, the graduations 5 are not restricted to the embodiment of FIGS. 1–5 but may be graduations provided at 10 degree intervals progressively from the reference graduations 5*a*.

A distal end of each of the reference graduations 5*a* has a circular arc-shaped indicator having an arrow head 9 and extending circumferentially of the rear edge surface 3 of the grip 1. The arrow head 9 serves as an indicator for the direction of adjustment in the fitting angle of the grip 1 and also as an embellishment in design. However, the arrow head 9 is optional.

In accordance with the embodiment of FIGS. 1–5, the graduations 5 are provided directly on the rear end surface 3 of the grip 1. However, a seal stamp or a plate having the graduations 5 and separate from the grip 1 may be attached to the rear end surface 3 of the grip 1.

Figure 5A:
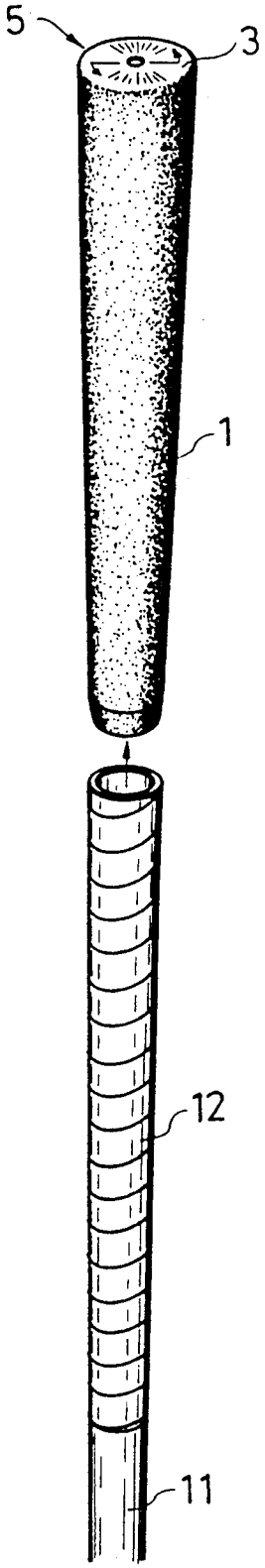
FIG. 5 (A), (B) and (C) are perspective illustrations of fitting the grip of FIG. 1 onto a golf club shaft rear portion FIG. 5 (A) illustrating a prefitting relation between the grip and shaft rear portion, FIG. 5 (B) illustrating a postfitting relation between the grip and shaft rear portion, in their fitting positions, and FIG. 5 (C) illustrating a postfitting relation between the grip and shaft rear portion.
Figure 5B:
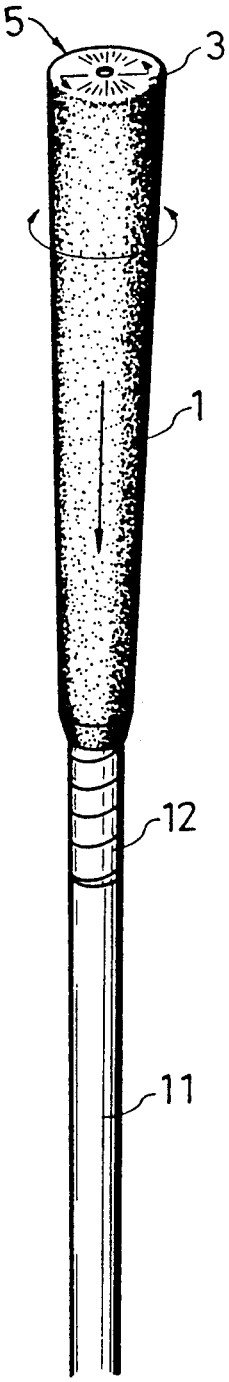
Figure 5C:
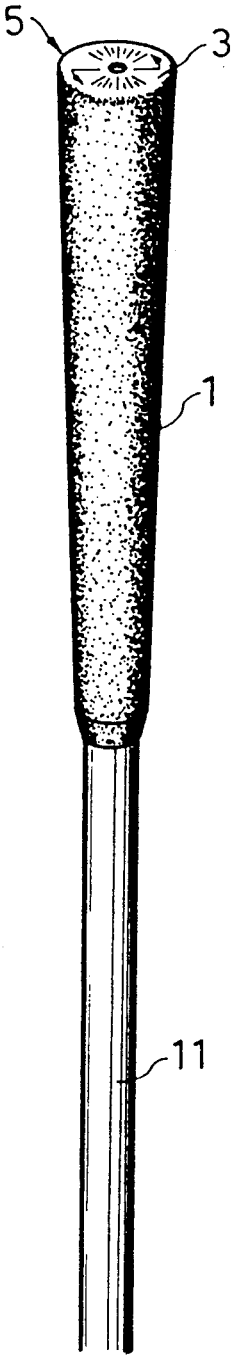
Figure 6:
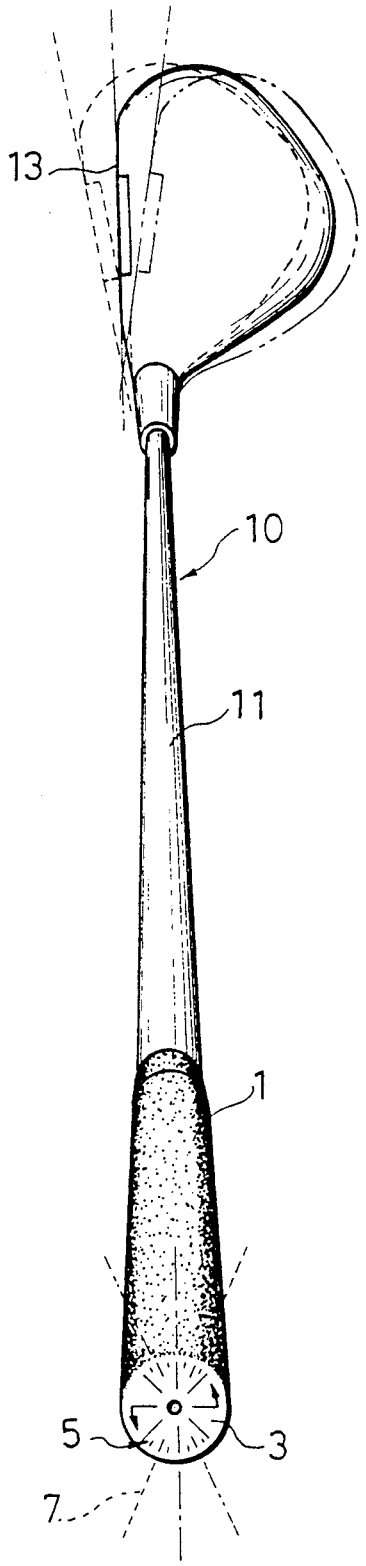
FIG. 6 is a perspective illustration of a wood club with the fitting angle of the grip changed.
Figure 7:
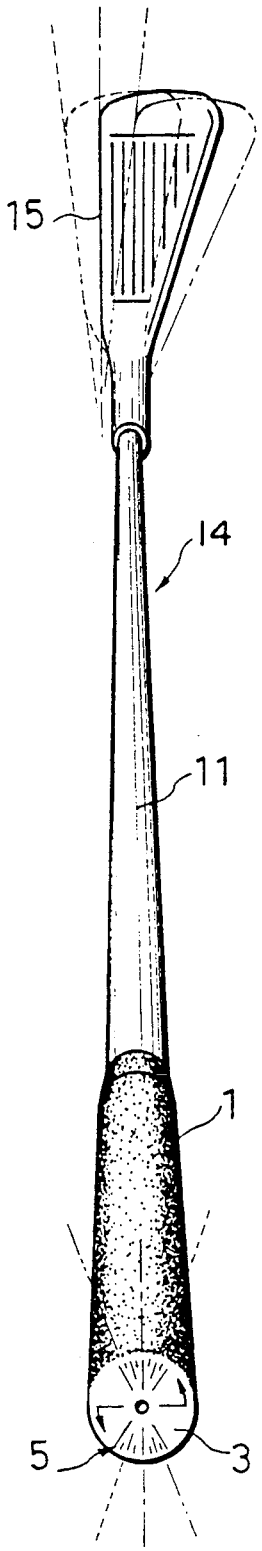
FIG. 7 is a perspective illustration of an iron club with the fitting angle of the grip changed.

FIGS. 5–7 illustrate a manner of fitting the grip 1 of the present invention on the club shaft 11.

As in a prior-art method of fitting the grip on the club shaft, a pressure sensitive adhesive double coated tape 12 is wound around the shaft rear end in a predetermined range. Then, benzine is sufficiently sprayed onto the wound tape 12 as shown in FIG. 5 (A). Additionally, benzine is also sufficiently sprayed onto the inner surface of the grip 1. Then, the grip 1 is slid onto the tape 12 wound around the rear portion of the club shaft 11 as shown in FIG. 5B.

When a golfer desires a particular angle, e.g., a hook angle of 22.5 degrees in fitting the grip 1 on the rear end of the club shaft 11, he previously notes the intermediately long graduation 7 of FIG. 6 provided at 22.5 degrees and providing the 22.5 degree hook angle or he may mark the same graduation 7 by means of a marker or writing instrument. The golfer directs his eye at the rear edge surface 3 of the grip 1 and positions the grip 1 so that the same graduation 7 aligns with the face 13 of the golf club 10. Then, the golfer fits the grip 1 onto the tape 12 wound around the rear portion of the club shaft 11 as shown in FIG. 5B so that the position of the grip 1 will align with the club face of the 22.5 degree hook angle as shown in FIG. 5C.

FIG. 6 illustrates the wood golf club 10. FIG. 7 illustrates an iron golf club 14. Alternate long and short dash lines, alternate long and two short dash lines and dotted lines of FIGS. 6 and 7 indicate changes in orientations of the club faces 13 and 15 in response to the fitting angle of the grip 1.

What is claimed is:

1. A fitting-angle adjustment mark for a grip of a golf club, the grip being in the form of a bottomed hollow cylinder and fitting on the rear end of the golf club, wherein the rear end surface of the grip has indices or graduations at predetermined angular intervals with reference to a back line of the grip, and wherein radially extending grooves defined in the rear end surface of the grip constitute the graduations.

2. A fitting-angle adjustment mark for a grip of a golf club as recited in claim 1, wherein the grooves are colored.

3. A fitting-angle adjustment mark for a grip of a golf club as recited in claim 1, wherein the ridges are colored.

4. A fitting-angle adjustment mark for a grip of a golf club, the grip being in the form of a bottomed hollow cylinder and fitting on the rear end of the golf club, wherein the rear end surface of the grip has indices or graduations at predetermined angular intervals with reference to a back line of the grip, and wherein radially extending ridges provided on the rear end surface of the grip constitute the graduations.

5. A fitting-angle adjustment mark for a grip of a golf club, the grip being in the form of a bottomed hollow cylinder and fitting on the rear end of the golf club, wherein the rear end surface of the grip has indices or graduations at predetermined angular intervals with reference to a back line of the grip, and wherein the graduations comprise a reference graduation provided at a predetermined angular distance from the position of the back line, great graduations at 45 degree intervals progressively from the reference graduation, middle graduating at 22.5 degree intervals progressively from the reference graduation between the reference graduation and great graduations, and small graduations at 11.25 degree intervals progressively from the reference graduations between the reference graduation, great graduations and middle graduations.

6. A fitting-angle adjustment mark for a grip of a golf club, the grip being in the form of a bottomed hollow cylinder and fitting on the rear end of the golf club, wherein the rear end surface of the grip has indices or graduations at predetermined angular intervals with reference to a back line of the grip, and wherein the graduations radially extend and the distal end of at least one of the graduations has a circular arc extending circumferentially of the rear end surface of the grip, the distal end of the arc having an arrow head.

* * * * *

UNITED STATES PATENT AND TRADEMARK OFFICE

CERTIFICATE OF CORRECTION

PATENT NO. : 5,058,891

DATED : October 22, 1991

INVENTOR(S) : Mikio Takeuchi

It is certified that error appears in the above-identified patent and that said Letters Patent is hereby corrected as shown below:

Title page, item [30], add

Foreign Application Priority Data

| | | |
|---|---|---|
| August 4, 1989 | Japan | 1-92000/1989 |

Signed and Sealed this

Thirtieth Day of March, 1993

*Attest:*

STEPHEN G. KUNIN

*Attesting Officer*

*Acting Commissioner of Patents and Trademarks*